United States Patent [19]

Yarm

[11] 4,408,757

[45] Oct. 11, 1983

[54] SHEET SEPARATING DEVICE

[75] Inventor: Jay M. Yarm, Milford, Conn.

[73] Assignee: Pitney Bowes Inc., Stamford, Conn.

[21] Appl. No.: 343,686

[22] Filed: Jan. 28, 1982

[51] Int. Cl.[3] ..... B65H 29/56

[52] U.S. Cl. ..... 271/311; 271/DIG. 2; 432/60

[58] Field of Search ..... 271/307, 311, 312, DIG. 2; 432/60; 118/245

[56] References Cited

U.S. PATENT DOCUMENTS

| | | | |
|---|---|---|---|
| 3,844,252 | 10/1974 | Thettu | 432/60 X |
| 3,957,423 | 5/1976 | Mueller | 432/60 |
| 4,062,534 | 12/1977 | Sasahara | 271/311 |
| 4,065,120 | 12/1977 | Imaizumi | 271/311 |

*Primary Examiner*—Richard A. Schacher

*Attorney, Agent, or Firm*—Martin D. Wittstein; Albert W. Scribner; William D. Soltow, Jr.

[57] ABSTRACT

A two piece articulated stripping device is provided, having an elongate member pivotally connected to a fixed support on a copier so that a free end of the member is in juxtaposition with the outer surface of a heated fuser roll.

5 Claims, 4 Drawing Figures

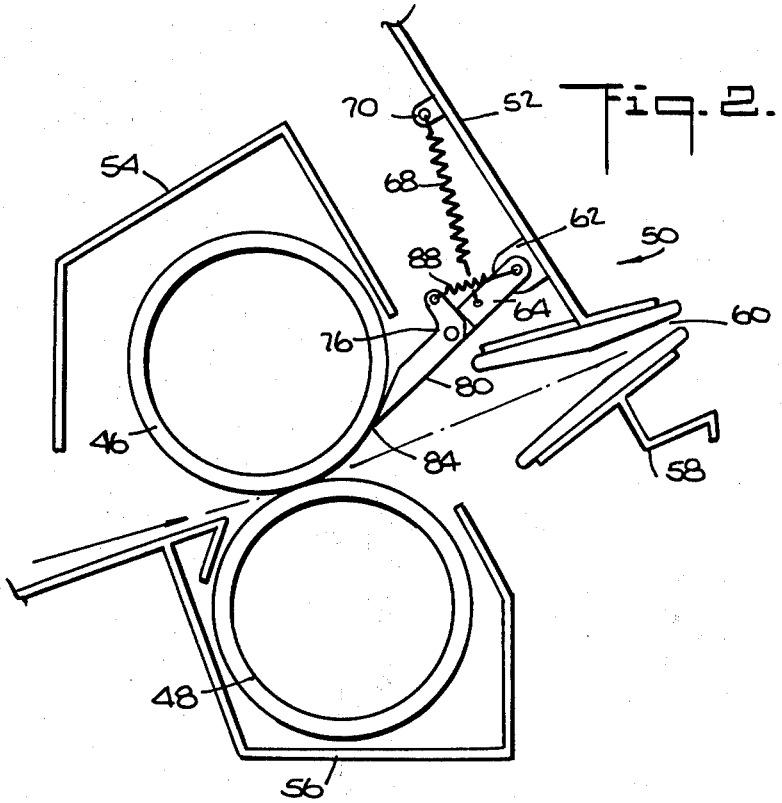
Fig. 2.
Fig. 3.
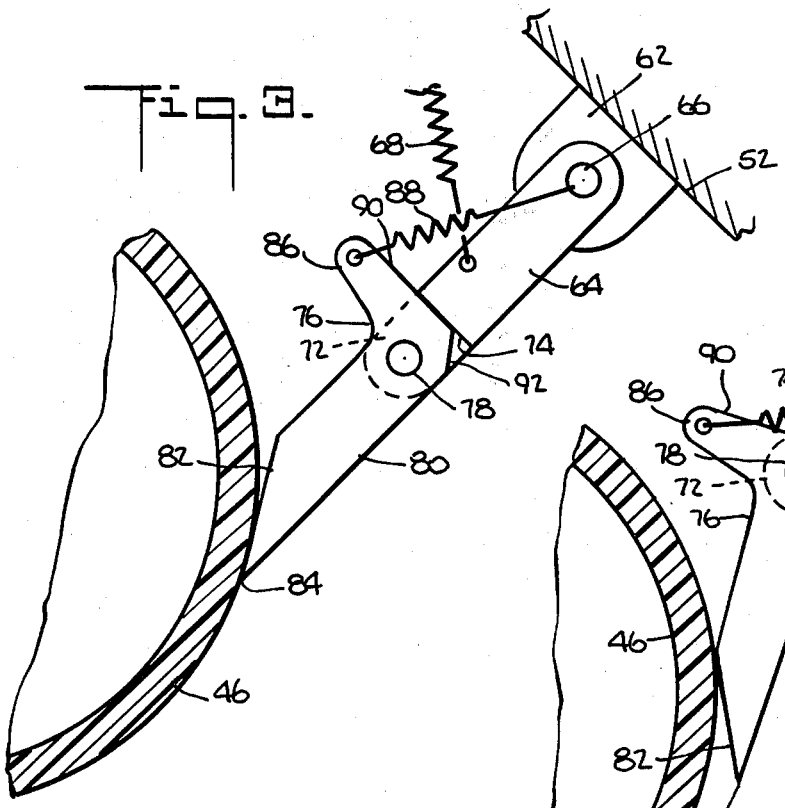
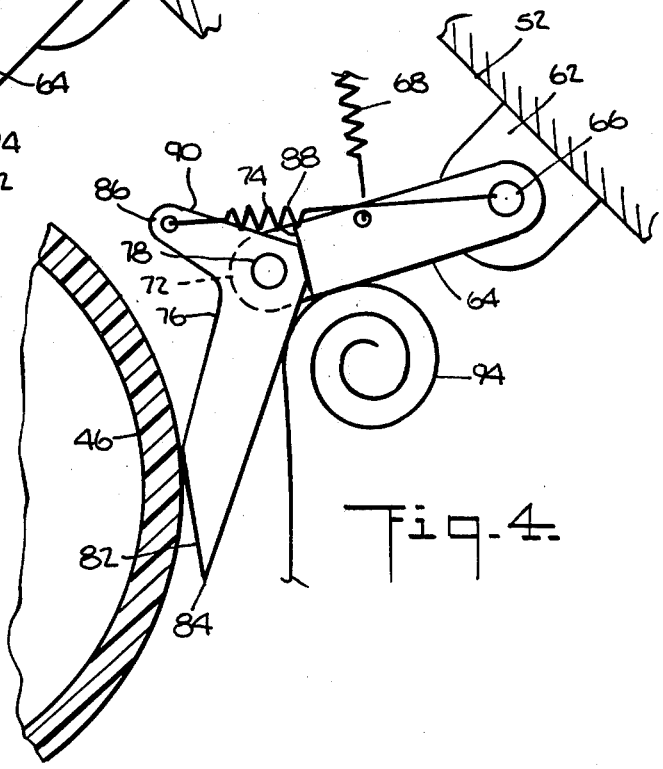
Fig. 4.

SHEET SEPARATING DEVICE

BACKGROUND OF THE INVENTION

1. Field of the Invention

This invention relates generally to the field of electrophotographic copying machines, and more particularly to a stripping device used in such copying machines for stripping sheets of copy paper from a heated fusing roller.

Generally, in an electrophotograhic copying machine, an original document is illuminated and an optical image of the document is reflected onto a uniformity charged photoconductive element, usually in the form of a drum or a belt. The photoconductive element becomes discharged in the areas where it is struck by light, which correspond to the non-image areas of the document, but the photoconductive element retains its charge in the areas not struck by light, which correspond to the image areas of the document. Thus, a latent or charge image of the document is produced on the photoconductive member. A suitable colored developing material, or toner, is applied to the photoconductive member and is retained thereon in the charged areas so that the charge image on the photoconductive member is thereby rendered visible, or exposed. A sheet of copy paper is brought into contact with the photoconductive member and the developed image thereon, and the image is transferred by suitable electrostatic techniques to the sheet of copy paper. The toner image must now be permanently affixed to the sheet of copy paper, and one very desirable and frequently used technique for doing this is by hot roll fusing. This technique is desirable because it very effectively fuses the toner to the copy paper and does so without any adverse effect on the condition or appearance of the paper. At least one of the rollers between which the copy paper passes is heated sufficiently so that the toner is raised substantially to its melting temperature which causes the toner to melt enough to be thoroughly absorbed into the body of the paper without smearing. The sheet of copy paper with the fused image thereon is then ejected from the copying machine.

One of the major drawbacks of the hot roll fusing technique mentioned above is that of the copy paper sticking to the heated roll of the fusing apparatus and becoming wrapped around the roll instead of exiting from the copying machine. This occurs because the toner becomes very tacky when it is heated substantially to its melting point for fusing and the tackiness of the toner causes the lead edge of the copy sheet to adhere to the roller rather than passing straight through the pair of rollers to exit from the copying machine. This problem occurs particularly frequently when the toner image on the copy sheet is relatively close to the lead edge of the copy sheet due to the fact that the closer the toner image is to the lead edge of the copy sheet, the greater is the adhesion force of the copy sheet to the heated roll. The above drawback of heated roll fusing devices has been rather effectively overcome in some instances by providing the heated roll with a surface layer consisting of a material having a relatively low adhesion characteristic such as TEFLON, and additionally providing a coating on the surface layer of a suitable release agent such as silicon oil. However, one disadvantage of this solution is the necessity for having apparatus associated with the hot roll fusing assembly for maintaining a supply of the silicon oil and for continuously applying an extremely thin and uniform coating of the oil to the heated roll. Obviously this entails added complexity and cost to the copying machine which it would be most desirable to avoid. Also, it happens occasionally that too much oil is applied to the heated roll and it is transferred to the copy sheet with the result that the copy sheet has an objectionable appearance and texture.

An alternative solution to the problem of copy sheets adhering to the heated roller is the use of a surface layer on the roller consisting of a material which has good characteristics as a release agent without the addition of liquid release agent as or discussed above, such material for example being silicon rubber or fluoro-rubber. However, these materials are not as effective in always assuring that the copy paper will not adhere to the heated roll as when a liquid release agent is used, and accordingly it has become commonplace to utilize a mechanical stripping means in combination with heated rolls which are covered with a surface layer of silicon rubber. A typical form of stripping means comprises a plurality of stripping fingers mounted in close proximity to the surface of the heated roll, each finger having a tapered configuration terminating in a knife edge which lies in contact with the surface of the heated roll to prevent the copy sheet from adhering to the surface and being drawn around the roll.

A major problem with such stripping or separating devices is that they can seriously damage the heated fuser roller in the event of paper jam. Typically, the fuser rollers of a hot roll fuser assembly are confined within a housing for safety purposes, and if a sheet of copy paper is not properly stripped from the heated roller it may press against the underside of the separating devices with considerable force. This force can easily be sufficient to cause the knife edge on the stripper device to gouge into the soft silicon rubber coating of the heated fuser roller and groove the surface to the point of irreparable damage since a groove roller cannot provide uniform fusing of a toner image on a sheet of copy paper.

2. Prior Art

Several attempts have been made in the past to solve these problems, but none has been entirely satisfactory. One such attempt is shown in U.S. Pat. No. 3,844,252, in which a stripper finger is releasably held in a normal operating position by a resilient clip which grips a mounting post. If a paper jam occurs, the resilient clip yields and releases the mounting post and allows the stripper finger to shift to an inoperative position. A principal difficulty with this arrangement is that it requres a considerable amount of force to cause the resilient clip to yield, and damage to a soft roller coating can still result. Also it is difficult to accurately control the amount of force which is required to cause the resilient clip to yield.

Another attempted solution to this problem is shown in U.S. Pat. No. 4,065,120 in which a pair of stripping devices are mounted on a supporting bar which is carried by side frame members of the fusing apparatus. The supporting bar is movably mounted in such a way that if a jam occurs, the stripper fingers are forced into frictional contact with the surface of the fuser roller with sufficient force to cause the mounting bar to move to disengage the knife edge of the stripper finger from the surface of the fuser roller. A significant drawback of this system is that it requires for its operation an increase in the very characteristic which is causing the damage in the first place, specifically pressure of a knife edge on the relatively soft surface of a silicon rubber coating.

BRIEF SUMMARY OF THE INVENTION

The present invention substantially overcomes if not completely eliminates all of the problems mentioned above. As will be seen more fully from the detailed description which follows, the separating device of the present invention has the advantage of being sensitive to, and operationally reponsive to, a very small amount of force exerted on the separating device from a curled or rumpled sheet of paper which is not being properly separated from the fuser roller and being ejected from the copier. In addition, the separating device of the present invention has the significant advantage that as soon as the separating device begins to respond to the above noted small amount of pressure the knife edge of the stripper finger is immediately disengaged from the surface of the fuser roller and it is effectively maintained away from the surface, thereby assuring that no damage can result to the surface regardless of how much force is developed from the jammed sheet of paper.

The present invention, in its broader aspects, is generally a two-piece articulated stripping device which comprises an elongate member which is pivotally connected to a fixed support means on the copier so that the free end of the elongate member is in juxtaposition with the outer surface of the heated fuser roller. A stripper finger is pivotally connected to the free end of the elongate member and has a knife edge at the free end thereof. A resilient means interconnects both the elongate member and the stripper finger with the fixed support in such a manner as normally to maintain the elongate member and the stripper finger in substantial alignment and with the knife edge of the stripper finger in scraping engagement with the surface of the fuser roller, but acts to move both the elongate member and the stripper finger out of the substantial alignment and thereby move the knife edge away from the surface in response to a force exerted on the elongate member or the stripper finger in a direction which would tend to cause the knife edge to gauge into the roller surface.

The foregoing and other advantages and features of the present invention will become more apparent from an understanding of the following detailed description of a preferred embodiment of the present invention when considered in conjunction with the accompanying drawings in which:

FIG. 2 is an enlarged sectional view of the fusing apparatus of the copier shown in FIG. 1 and illustrating the separating device of the present invention;

FIG. 3 is a further enlarged view of the separating device shown in FIG. 2 and showing the parts in their normal operating positions; and FIG. 4 is a view similar to FIG. 3 but showing the parts in the positions they assume as the result of a paper jam.

DETAILED DESCRIPTION OF PREFERRED EMBODIMENTS

Figure 1:
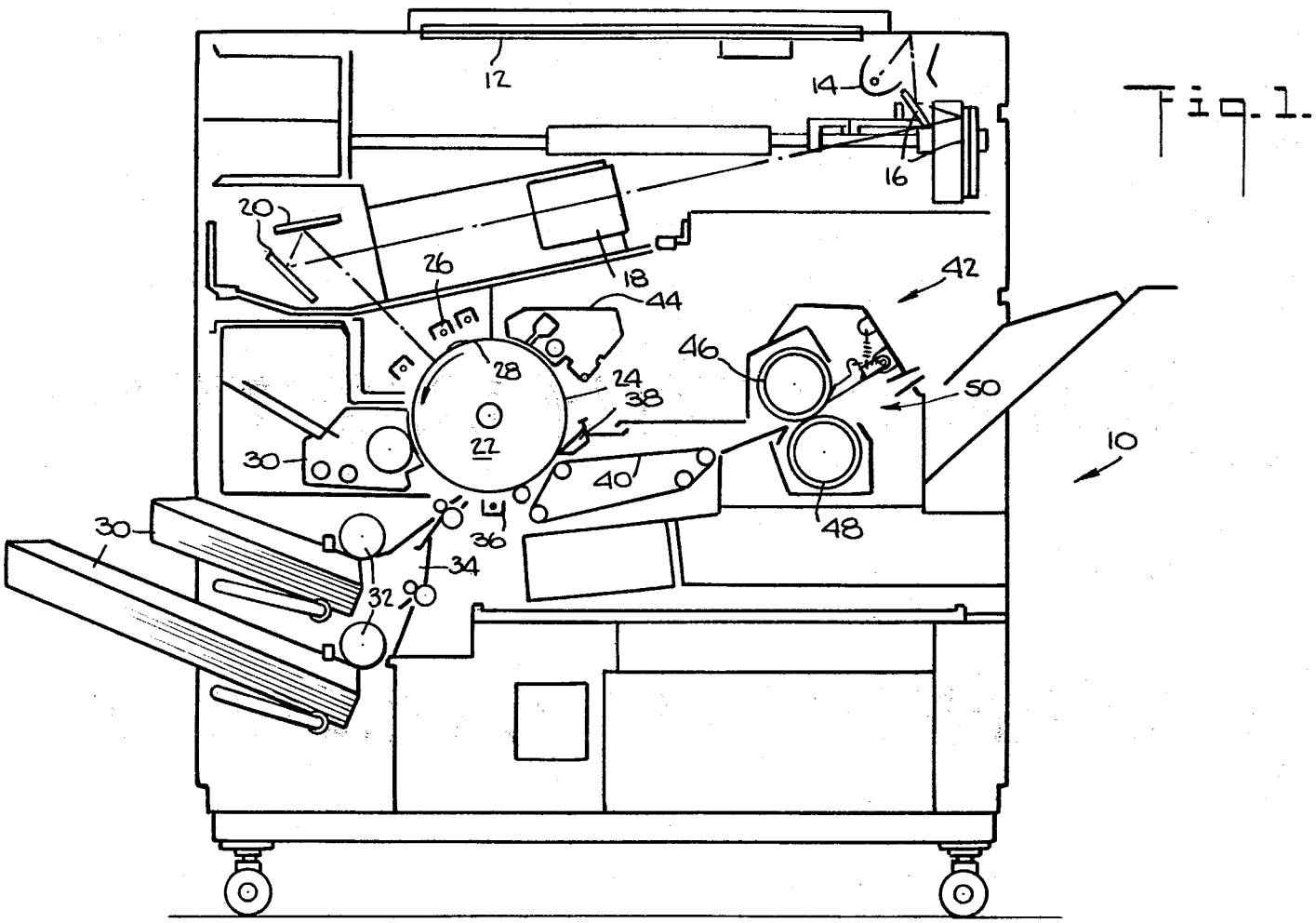
FIG. 1 is a simplified, partly schematic and partly sectional view of a typical copying machine in which the present invention would be utilized.

Referring now to the drawings and particularly to FIG. 1 thereof, there is shown for illustrative purposes a typical copying machine in which the present invention would be used. The copying machine, generally designated by the reference numeral 10 comprises an optical system having a glass platen 12 on which a document is placed for copying, a reciprocating illuminating means 14 which scans the document, a movable mirror system 16, a lens 18 and a fixed mirror system 20 all for the purpose of projecting an image of the indicia on the document to a photoconductor drum 22. The drum 22 has a photoconductive surface 24 which is capable of being uniformly charged and selectively discharged only in the light struck areas in a manner well known in the art.

The copying machine 10 also includes a charging device 26 for uniformly charging the photoconductive suface 24 before it is exposed to the light image at an exposing station indicated by the numeral 28. As the drum 22 rotates in the direction of the arrow, the photoconductive surface passes by a developing apparatus 30 which contains a quantity of developing material or toner, as is well known in the art, and a rotating applicator roller, which is suitably magnetized so as to develop a brush-like layer of toner thereon, brings the toner material into contact with the photoconductive surface 24. The toner is electrostatically attracted to the charged areas of the photoconductive surface 24 but is not attracted to the areas which have been discharged by the light reflected from the non-image areas of the document. Thus a visible toner image is developed on the photoconductive surface 24.

The copying machine 10 further includes at least one and preferably two supplies of copy paper 30, each supply having a feeding means 32 for feeding sheets of copy paper from the supply 30 into a feed path 34 which ultimately brings the copy paper into contact with the photoconductive surface 24. The copy paper is fed from the supply so that the leading edge of each sheet comes into contact with the photoconductive surface in synchronism with the leading edge of the image of the document on the photoconductive surface, and the sheet of copy paper then travels with the drum for a short distance. A charging device 36 effectively neutralizes the electrostatic attraction of the toner material to the photoconductive surface 24 and electrostatically attracts the toner to the sheet of copy paper thereby effecting a complete transfer of the toner image from the photoconductive surface 24 to the adjacent surface of the sheet of copy paper. A suitable separating device 38, which may be a combination of an air puffing device and mechanical separating fingers, separates the leading edge of the copy paper from the photoconductive surface 24 so that the entire sheet is stripped from the photoconductive surface and is deposited onto a suitable conveyor 40 which carries the sheet of copy paper to a fusing device generally designated by the reference numeral 42. Any residual toner which may remain on the photoconductive surface after the sheet of copy paper is separated therefrom is cleaned from the photoconductive surface by a cleaning apparatus 44, and the photoconductive surface is then ready for another cycle of operation.

The conveyor 40 carries the sheet of copy paper to the fusing apparatus 42 which comprises a heated roller 46 and a back-up roller 48. The rollers 46 and 48 are mounted so as to be in sufficient pressure engagement to feed the sheet of copy paper therebetween, and the roller 46 is heated, usually by a suitable heating device mounted within the roller, to a temperature which is sufficient to almost melt the toner on the sheet of copy paper so that it becomes impregnated into the copy paper and is thereby rendered permanent. After passing between the fusing rollers 46 and 48, the sheet of paper is separated from the rollers by a separating mechanism generally designated by the reference numeral 50, and which is the subject of the present invention. The finished sheet of copy paper is then deposited in the collection bin 52 for retrieval by the operator of the copying machine.

Referring now to FIGS. 2,3, and 4, the separating mechanism 50 is shown in detail. It should be understood that the separating mechanism 50 comprises a plurality of separating devices spaced along the length of the heated fuser roller 46, usually either two or four such separating devices being utilized. The separating devices may be mounted in operative position in any suitable manner, such as on a bar or plate which extends between support members located on either side of the fusing rollers. For purposes of illustration, the separating device of the present invention is shown as being mounted on a plate 52 which in turn is supported by suitable side frame members (not shown) which would also support the rollers 46 and 48 for rotation and which would also support the housing units 54 and 56 which surround the rollers 46 and 48. The plate 52, in cooperation with another plate 58 which is similarly supported, suitably defines a throat 60 through which the copy sheet passes after it has been separated from the fuser roller 46. Although separating devices may be used on both rollers, it is usually necessary to utilize separating devices only in conjunction with the heated roller 46 for the reason that it is only this roller to which the sheet of copy paper is apt to adhere because of the tackiness of the toner on the sheet of paper or because of small deposits of toner which build up on the heated roller after long periods of use.

Each separating device 50 comprises an upstanding boss 62 suitably affixed to the plate 52, and an elongate link 64 which is pivotally connected as by a pin 66 to the boss 62. A tension spring 68 is connected at one end to the link 64 adjacent the free end thereof and at the other end to a boss 70 also suitably affixed to the plate 52, the spring 68 thereby normally urging the link 64 in a clockwise direction about the pivot pin 66. The link 64 has a short portion 72 at the free end thereof which is of reduced thickness so as to form an abutment shoulder 74 which extends the full width of the link 64.

An L-shaped stripper finger 76 is pivotally connected as by the pivot pin 78 to the reduced end portion 72 of the link 64. The finger 76 has a relatively long leg 80 having a tapered surface 82 which defines a knife edge 84 at the end of the leg 80. The stripper finger also has a relatively short leg 86 to the outer end of which is connected one end of a second tension spring 88, the other end of the tension spring 88 being connected to the pivot pin 66 or other suitable nearby location, so that the spring 88 normally tends to urge the L-shaped stripper finger 76 in a clockwise direction about the pivot pin 78.

The stripper finger 76 has two abutment surfaces which cooperate with the abutment shoulder 74 on the link 64 to limit the relative movement of the link 64 and the stripper finger 76. One abutment surface is the edge surface 90 of the short leg 86, and this surface is shown in abuting engagement with the abutment shoulder 74 in FIG. 3, which shows the link 64 and stripper finger 76 in their normal operating positions. It will be apparent that the engagement of the abutment surface 90 with the abutment shoulder 74 limits the extent to which the stripper finger 76 can pivot in a clockwise direction about the pin 78 in response to the action of the spring 88. It will also be apparent that the engagement of the knife edge 84 with the surface of the roller 46 limits the extent to which the link 64 can pivot in a clockwise direction about the pin 66 in response to the action of the spring 68. In other words, with the parts as shown in FIG. 3, the link 64 and the stripper finger 76 are effectively a single member which can pivot about the pin 66 in order to accommodate any unevenness in the roller 46 as it rotates with the edge 84 bearing against the surface of the roller. The spring 88 is selected so as to cause the edge 84 to ride on the surface of the roller 46 with a relatively light pressure so that the edge 84 does not wear a groove into the surface of the roller.

The stripper finger 80 is provided with a second abutment surface 92, best seen in FIG. 3, which is adapted to engage with the abutment shoulder 74 when the stripper finger 80 and the link 64 are in the positions shown in FIG. 4. The engagement of the abutment surface 92 and the abutment shoulder 74 limits the extent to which the stripper finger can pivot in a counter-clockwise direction relative to the link 64 in response to pressure from a sheet of copy paper and against the influence of the spring 88 in the manner described below.

At such time as a paper jam occurs in the normally confined space between fuser rollers 46 and 48, the surrounding housing structure 56 and the structure defining the throat 60, as best seen in FIG. 2, a sheet of copy paper curls or rumples in this confined space, as indicated by the scroll line 94 in FIG. 4, and the force exerted by the sheet of paper on the underside of the separating device 50 would normally be sufficient to cause the knife edge 84 to gouge into the soft silicon rubber coating of the roller 46 and thereby wear grooves in the coating. Such grooves would have an adverse effect on the ability of the roller 46 to cause uniform fusing of a toner image on the sheet of copy paper.

With a separator device according to the present invention this type of damage to the fuser roller is entirely avoided. By comparison of the position of the parts in FIGS. 3 and 4, it will be seen that when a paper jam occurs as described above, the force exerted on the underside of the separator device 50 is sufficient to overcome the force of the spring 88 so that the stripper finger 76 is caused to pivot in a counter-clockwise direction relative to the link 64. As soon as the stripper finger 76 begins to move in the counter-clockwise direction, the spring 68 also causes the link 64 to pivot in a clockwise direction about the pivot pin 66. Both the stripper finger 76 and the link 64 will pivot in the respective above described directions until the abutment surface 92 engages the abutment shoulder 74, and also until a rear portion of the tapered surface 82 rides on the surface of the roller 46. In this position, as clearly shown in FIG. 4, the knife edge 84 is spaced away from the surface of the roller 46 so that it cannot cause any damage thereto regardless of the force exerted by the curled or rumpled sheet of copy paper. And since the surface 82 is smooth it cannot cause any damage to the surface of the roller 46 by remaining in contact therewith. It should be noted that the springs 68 and 88 are carefully selected so as to provide a precisely predetermined amount of force. The spring 68 pulls on the link 64 with only enough force to cause the knife edge 84 to maintain light contact with the surface of the roller 46 while the link 64 and separator finger 76 are normally aligned and effectively constitute a single member which can pivot about the pivot pin 66. And the spring 88 exerts only enough force on the stripper finger 76 to normally maintain the long leg 80 of the stripper finger 76 in alignment with the link 64 so that even slight pressure from a curled sheet of copy paper will overcome the force of the spring 88 and break the alignment to allow the parts to move to the positions shown in FIG. 4. The spring 88, pulling the stripper finger 76 in a clockwise direction about the pivot pin 78, provides the force which maintains the alignment of the stripper finger 76 and the link 64 with the abutment surface 90 in engagement with the abutment shoulder 74. The spring 68, pulling both the link 64 and the stripper finger 76 in a clockwise direction about the pivot 66, provides the force which normally maintains the knife edge 84 in contact with the surface of the roller 46.

When a sheet of copy paper jams in the confined space within the fuser assembly frame 54–56, it requires only a very small force exerted by the rumpled or curled sheet of paper 94 exerted on the stripper finger 76 or the link 64 or both to break the alignment of these parts against the action of the spring 88. After these parts have moved only a very small amount, the spring 68 will cause the parts to move to the positions shown in FIG. 4 in which the abutment surface 92 is now in engagement with abutment shoulder 74 and the knife edge is spaced away from the surface of the roller 46. It should be noted that the knife edge 84 is removed from contact with the surface of the roller 46 as soon as the parts commence the above described movement so that it is virtually impossible for the knife edge to gouge into the roller surface.

What is claimed is:

1. In a photocopy machine wherein a toner image is produced on a sheet of copy paper and is fused thereto by passing the sheet of copy paper between a pair of fusing rollers, at least one of which is heated and has a relatively soft outer surface, a sheet separating device for stripping sheets of copy paper from the heated fuser roller, said device comprising:

A. fixed support means located adjacent the heated fuser roller,

B. an elongate member pivotably mounted on said support means with a free end of said elongate member in juxtaposition with the outer surface of said heated fuser roller, C. a stripper finger pivotally connected to said free end of said elongate member and having a knife edge formed at the free end of said stripper finger, and D. resilient means interconnecting both said elongate member and said stripper finger with said fixed support for normally maintaining said elongate member and said stripper finger in substantial alignment and with said knife edge in scraping engagement with said surface of said roller, but acting to move both said elongate member and said stripper finger out of said substantial alignment and thereby move said knife edge away from said surface in response to a force exerted on said elongate member or said stripper finger in a direction which would tend to cause said knife edge to gouge into said surface.

2. A sheet separating device as set forth in claim 1 wherein said resilient means comprises means defining a pair of resilient forces, one of which acts on said stripper finger to maintain said stripper in said substantial alignment with said elongate member, and the other of which acts on said elongate member to urge said elongate member in a direction which maintains said knife edge in scraping engagement with said surface of said roller so long as said substantial alignment is maintained but which pulls said elongate member to an alternate position when said substantial alignment is broken by a paper jam so as to move said knife edge away from said surface of said roller.

3. A sheet separating device as set forth in claim 2 wherein said means defining said one of said resilient forces comprises a tension spring connected between said stripper finger and said elongate member, and said means defining said other of said resilient forces comprises a tension spring connected between said elongate member and said fixed support means.

4. A sheet separating device as set forth in claim 1 wherein said elongate member has an abutment shoulder adjacent said free end thereof, and said stripper finger has a first abutment surface adapted to engage with said abutment shoulder when said elongate member and said stripper finger are in said substantial alignment, said resilient means normally maintaining said abutment shoulder and said abutment surface in engagement with each other.

5. A sheet separating device as set forth in claim 4 wherein said stripper finger has a second abutment surface adapted to engage with said abutment shoulder on said elongate member to limit the extent of relative movement between said stripper finger and said elongate member when they are moving from said substantial alignment to an alternate position in which said knife edge is not in engagement with said surface of said roller.

* * * * *